US009426598B2

(12) United States Patent
Walsh et al.

(10) Patent No.: US 9,426,598 B2
(45) Date of Patent: Aug. 23, 2016

(54) SPATIAL CALIBRATION OF SURROUND SOUND SYSTEMS INCLUDING LISTENER POSITION ESTIMATION

(71) Applicant: DTS, Inc., Calabasas, CA (US)

(72) Inventors: Martin Walsh, Scotts Valley, CA (US); Guangji Shi, San Jose, CA (US)

(73) Assignee: DTS, Inc., Calabasas, CA (US)

( * ) Notice: Subject to any disclaimer, the term of this patent is extended or adjusted under 35 U.S.C. 154(b) by 0 days.

(21) Appl. No.: 14/332,098

(22) Filed: Jul. 15, 2014

(65) Prior Publication Data

US 2015/0016642 A1 Jan. 15, 2015

Related U.S. Application Data

(60) Provisional application No. 61/846,478, filed on Jul. 15, 2013.

(51) Int. Cl.

| | |
|---|---|
| ***H04R 5/02*** | (2006.01) |
| ***H04S 7/00*** | (2006.01) |
| *H04R 1/26* | (2006.01) |
| *H04R 1/40* | (2006.01) |

(52) U.S. Cl.

CPC . *H04S 7/301* (2013.01); *H04R 1/26* (2013.01); *H04R 1/406* (2013.01); *H04R 2201/403* (2013.01); *H04S 7/303* (2013.01)

(58) Field of Classification Search

CPC ..... H04S 7/301; H04S 7/303; H04R 1/26; H04R 1/406; H04R 2201/401; H04R 2201/403

USPC ..... 381/307, 303, 56, 58, 300, 92, 182, 17, 381/59, 91, 356, 26

See application file for complete search history.

(56) References Cited

U.S. PATENT DOCUMENTS

| | | | |
|---|---|---|---|
| 5,666,424 | A | 9/1997 | Fosgate et al. |
| 6,741,273 | B1 | 5/2004 | Waters et al. |
| 7,095,455 | B2 | 8/2006 | Jordan et al. |

(Continued)

FOREIGN PATENT DOCUMENTS

WO WO2012154823 A1 11/2012

OTHER PUBLICATIONS

Guangji Shi, Martin Walsh, and Edward Stein, "Spatial Calibration of Surround Sound Systems Including Listener Position Estimation," Audio Engineering Society Convention Paper, Oct. 9-12, 2014 Los Angeles, USA.

(Continued)

*Primary Examiner* — Paul S Kim

(74) *Attorney, Agent, or Firm* — William Johnson; Jianning Mai; Craig Fischer

(57) ABSTRACT

A method for calibrating a surround sound system is disclosed. The method utilizes a microphone array integrated in a front center loudspeaker of the surround sound system or a soundbar facing a listener. Positions of each loudspeaker relative to the microphone array can be estimated by playing a test signal at each loudspeaker and measuring the test signal received at the microphone array. The listener's position can also be estimated by receiving the listener's voice or other sound cues made by the listener using the microphone array. Once the positions of the loudspeakers and the listener's position are estimated, spatial calibrations can be performed for each loudspeaker in the surround sound system so that listening experience is optimized.

20 Claims, 7 Drawing Sheets

(56) References Cited

U.S. PATENT DOCUMENTS

| | | | | |
|---|---|---|---|---|
| 7,123,731 | B2 | 10/2006 | Cohen et al. | |
| 7,158,643 | B2 | 1/2007 | Lavoie et al. | |
| 7,676,044 | B2 | 3/2010 | Sasaki et al. | |
| 7,769,183 | B2 | 8/2010 | Bharitkar et al. | |
| 8,204,248 | B2 | 6/2012 | Haulick et al. | |
| 8,279,709 | B2 | 10/2012 | Choisel et al. | |
| 8,472,632 | B2 | 6/2013 | Riedel et al. | |
| 8,577,048 | B2 | 11/2013 | Chaikin et al. | |
| 2005/0281411 | A1 | 12/2005 | Vesely et al. | |
| 2007/0263889 | A1 | 11/2007 | Melanson | |
| 2010/0290643 | A1 | 11/2010 | Mihelich et al. | |
| 2012/0075957 | A1 | 3/2012 | De Bruijn | |
| 2012/0101610 | A1 | 4/2012 | Ojala et al. | |
| 2012/0106747 | A1 | 5/2012 | Crockett et al. | |
| 2012/0114151 | A1* | 5/2012 | Nguyen et al. | 381/303 |
| 2012/0288124 | A1* | 11/2012 | Fejzo et al. | 381/303 |
| 2013/0064042 | A1* | 3/2013 | Aarts et al. | 367/99 |
| 2013/0208898 | A1 | 8/2013 | Vincent et al. | |
| 2014/0119552 | A1 | 5/2014 | Beaucoup | |

OTHER PUBLICATIONS

Web page print out on Aug. 29, 2014: "Yamaha Digital Sound Projector, Model #YSP-5100," taken from url: http://usa.yamaha.com/products/audio-visual/hometheater-systems/digital-sound-projector/ysp-5100_black_u/?mode=model#psort=latest&mode=paging.

International Search Report and Written Opinion in corresponding PCT Application No. PCT/US2014/046738, mailed Nov. 6, 2014.

Yamaha Product YSP-5100 Digital Sound Projector print out obtained from http://usa.yamaha.com/products/audio-visual/hometheater-systems/digital-sound-projector/ysp-5100 black < u/?mode=model#psort=latest&mode=paging.

International Preliminary Report on Patentability in corresponding PCT Application No. PCT/US2014/046738, mailed Aug. 19, 2015, 18 pages.

* cited by examiner

| Test Trials | Measured Distance (cm) | TDOA (cm) | SRP-PHAT (cm) |
|---|---|---|---|
| Trial 1 | 169.4 | 155.2 | 162.3 |
| Trial 2 | 153.4 | 134.4 | 144.8 |
| Trial 3 | 125.7 | 115.6 | 136.7 |
| Trial 4 | 96.0 | 88.1 | 100.3 |
| Trial 5 | 109.7 | 92.2 | 97.0 |
| MSE | N/A | 207.5 | 84.9 |

SPATIAL CALIBRATION OF SURROUND SOUND SYSTEMS INCLUDING LISTENER POSITION ESTIMATION

CROSS REFERENCE TO RELATED APPLICATIONS

This application claims the benefit of U.S. Provisional Application No. 61/846,478, filed on Jul. 15, 2013, which is incorporated by reference in its entirety.

BACKGROUND

Traditionally, surround sound systems are calibrated using a multi-element microphone placed at a sweet spot or default listening position to measure audio signals played by each loudspeaker. The multi-element microphone is usually tethered to an AV receiver or processor by means of a long cable, which could be cumbersome for consumers. Furthermore, when a loudspeaker is moved or a listener is away from the sweet spot, existing calibration methods have no way to detect such changes without a full manual recalibration procedure. It is therefore desirable to have a method and apparatus to calibrate surround sound systems with minimum user intervention.

SUMMARY

A brief summary of various exemplary embodiments is presented. Some simplifications and omissions may be made in the following summary, which is intended to highlight and introduce some aspects of the various exemplary embodiments, but not to limit the scope of the invention. Detailed descriptions of a preferred exemplary embodiment adequate to allow those of ordinary skill in the art to make and use the inventive concepts will follow in later sections.

Various exemplary embodiments relate to a method, an apparatus and a system for calibrating multichannel surround sound systems. The apparatus may include a speaker, a headphone (over-the-ear, on-ear, or in-ear), a microphone, a computer, a mobile device, a home theater receiver, a television, a Blu-ray (BD) player, a compact disc (CD) player, a digital media player, or the like. The apparatus may be configured to receive an audio signal, process the audio signal and filter the audio signal for output.

Various exemplary embodiments further relate to a method for calibrating a multichannel surround sound system including a soundbar and one or more surround loudspeakers, the method comprising: receiving, by an integrated microphone array, a test signal played at a surround loudspeaker to be calibrated, the integrated microphone array mounted in a relationship to the soundbar; estimating a position of the surround loudspeaker relative to the microphone array; receiving, by the microphone array, a sound from a listener; estimating a position of the listener relative to the microphone array; and performing a spatial calibration to the surround sound system based at least on one of the estimated position of the surround loudspeaker and the estimated position of the listener.

In some embodiments, the microphone array includes two or more microphones. In some embodiments, the position of the surround loudspeaker and the position of the listener each includes a distance and an angle relative to the microphone array, wherein the position of the loudspeaker is estimated based on a direct component of the received test signal, and wherein the angle of the loudspeaker is estimated using two or more microphones in the microphone array and based on a time difference of arrival (TDOA) of the test signal at the two or more microphones in the microphone array. In some embodiments, the sound from the listener includes the listener's voice or other sound cues made by the listener. In some embodiments, the position of the listener is estimated using three or more microphones in the microphone array. In some embodiments, performing the spatial calibration comprises: adjusting delay and gain of a sound channel for the surround loudspeaker based on the estimated position of the surround loudspeaker and the listener; and correcting spatial position of the sound channel by panning the sound channel to a desired position based on the estimated positions of the surround loudspeaker and the listener. In some embodiments, performing the spatial calibration comprises panning a sound object to a desired position based on the estimated positions of the surround loudspeaker and the listener.

Various exemplary embodiments further relate to a method comprising: receiving a request to calibrate a multichannel surround sound system including a soundbar with an integrated microphone array and one or more surround loudspeakers; responsive to the request including estimating a position of a surround loudspeaker, playing a test signal at the surround loudspeaker; and estimating the position of the surround loudspeaker relative to the microphone array based on received test signal at the microphone array; responsive to the request including estimating a position of a listener, estimating the position of the listener relative to the microphone array based on a received sound of the listener at the microphone array; and performing a spatial calibration to the multichannel surround sound system based at least on one of the estimated position of the surround loudspeaker and the estimated position of the listener.

Various exemplary embodiments further relate to an apparatus for calibrating a multichannel surround sound system including one or more loudspeakers, the apparatus comprising: a microphone array integrated in a front component of the surround sound system, wherein the integrated microphone array is configured for receiving a test signal played at a loudspeaker to be calibrated, and for receiving a sound from the listener; an estimation module configured for estimating a position of the loudspeaker relative to the microphone array based on the received test signal from the loudspeaker, and for estimating a position of the listener relative to the microphone array based on the received sound from the listener; and a calibration module configured for performing a spatial calibration to the surround sound system based at least on one of the estimated position of the loudspeaker and the estimated position of the listener.

In some embodiments, the front component of the surround sound system is one of a soundbar, a front loudspeaker and an A/V receiver. In some embodiments, the position of the loudspeaker and the position of the listener each includes a distance and an angle relative to the microphone array, wherein the position of the loudspeaker is estimated based on a direct component of the received test signal, and wherein the angle of the loudspeaker is estimated using two or more microphones in the microphone array and based on a time difference of arrival (TDOA) of the test signal at the two or more microphones in the microphone array. In some embodiments, the position of the listener is estimated using three or more microphones in the microphone array. In some embodiments, performing the spatial calibration comprises: adjusting delay and gain of a sound channel for the loudspeaker based on the estimated position of the loudspeaker and the listener; and correcting spatial position of the sound channel by panning the sound channel to a desired position based on the estimated positions of the surround loudspeaker and the listener. In some embodiments, performing the spatial calibration comprises panning a sound object to a desired position based on the estimated positions of the surround loudspeaker and the listener.

Various exemplary embodiments further relate to a system for calibrating a multichannel surround sound system including one or more loudspeakers, the system comprising: a microphone array with two or more microphones integrated in a front component of the surround sound system, wherein the microphone array is configured for receiving a test signal played at a loudspeaker to be calibrated and for receiving a sound from the listener; an estimation module configured for estimating a position of the loudspeaker relative to the microphone array based on the received test signal from the loudspeaker, and for estimating a position of the listener relative to the microphone array based on the received sound from the listener; and a calibration module configured for performing a spatial calibration to the surround sound system based at least on one of the estimated position of the loudspeaker and the estimated position of the listener.

In some embodiments, the front component of the surround sound system is one of a soundbar, a front loudspeaker and an A/V receiver.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

Figure 1:
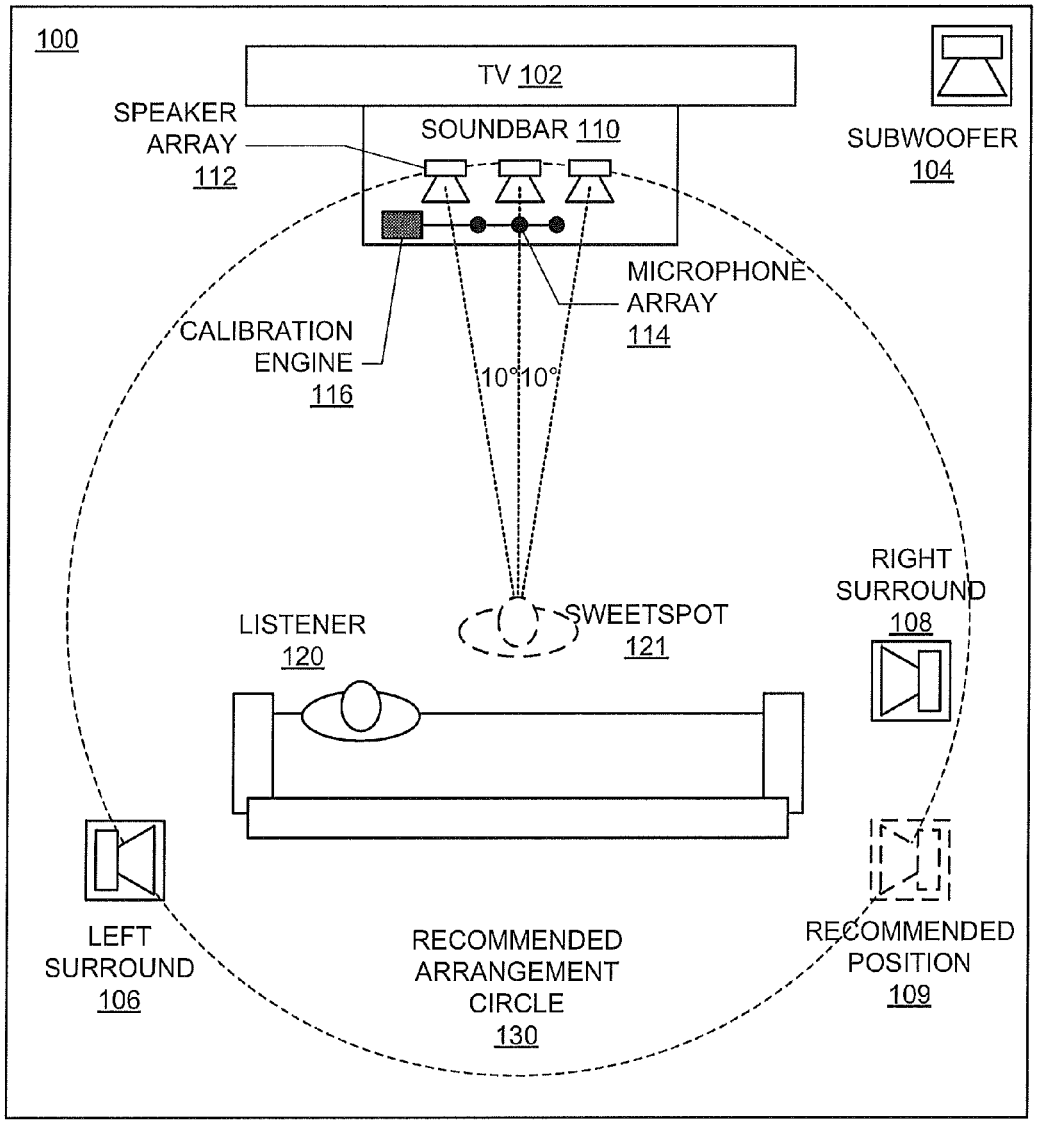
FIG. 1 is a high-level block diagram illustrating an example room environment for calibrating multichannel surround sound systems including listener position estimation, according to one embodiment.

The detailed description set forth below in connection with the appended drawings is intended as a description of the presently preferred embodiment of the invention, and is not intended to represent the only form in which the present invention may be constructed or utilized. The description sets forth the functions and the sequence of steps for developing and operating the invention in connection with the illustrated embodiment. It is to be understood, however, that the same or equivalent functions and sequences may be accomplished by different embodiments that are also intended to be encompassed within the spirit and scope of the invention. It is further understood that the use of relational terms such as first and second, and the like are used solely to distinguish one from another entity without necessarily requiring or implying any actual such relationship or order between such entities.

The present application concerns a method and apparatus for processing audio signals, which is to say signals representing physical sound. These signals are represented by digital electronic signals. In the discussion which follows, analog waveforms may be shown or discussed to illustrate the concepts; however, it should be understood that typical embodiments of the invention will operate in the context of a time series of digital bytes or words, said bytes or words forming a discrete approximation of an analog signal or (ultimately) a physical sound. The discrete, digital signal corresponds to a digital representation of a periodically sampled audio waveform. As is known in the art, for uniform sampling, the waveform must be sampled at a rate at least sufficient to satisfy the Nyquist sampling theorem for the frequencies of interest. For example, in a typical embodiment a uniform sampling rate of approximately 44.1 thousand samples/second may be used. Higher sampling rates such as 96 khz may alternatively be used. The quantization scheme and bit resolution should be chosen to satisfy the requirements of a particular application, according to principles well known in the art. The techniques and apparatus of the invention typically would be applied interdependently in a number of channels. For example, it could be used in the context of a "surround" audio system (having more than two channels).

As used herein, a "digital audio signal" or "audio signal" does not describe a mere mathematical abstraction, but instead denotes information embodied in or carried by a physical medium capable of detection by a machine or apparatus. This term includes recorded or transmitted signals, and should be understood to include conveyance by any form of encoding, including pulse code modulation (PCM), but not limited to PCM. Outputs or inputs, or indeed intermediate audio signals may be encoded or compressed by any of various known methods, including MPEG, ATRAC, AC3, or the proprietary methods of DTS, Inc. as described in U.S. Pat. Nos. 5,974,380; 5,978,762; and 6,487,535. Some modification of the calculations may be required to accommodate that particular compression or encoding method, as will be apparent to those with skill in the art.

The present invention may be implemented in a consumer electronics device, such as a Digital Video Disc (DVD) or Blu-ray Disc (BD) player, television (TV) tuner, Compact Disc (CD) player, handheld player, Internet audio/video device, a gaming console, a mobile phone, or the like. A consumer electronic device includes a Central Processing Unit (CPU) or Digital Signal Processor (DSP), which may represent one or more conventional types of such processors, such as an IBM PowerPC, Intel Pentium (x86) processors, and so forth. A Random Access Memory (RAM) temporarily stores results of the data processing operations performed by the CPU or DSP, and is interconnected thereto typically via a dedicated memory channel. The consumer electronic device may also include permanent storage devices such as a hard drive, which are also in communication with the CPU or DSP over an I/O bus. Other types of storage devices, such as tape drives and optical disk drives, may also be connected. A graphics card is also connected to the CPU via a video bus, and transmits signals representative of display data to the display monitor. External peripheral data input devices, such as a keyboard or a mouse, may be connected to the audio reproduction system over a USB port. A USB controller translates data and instructions to and from the CPU for external peripherals connected to the USB port. Additional devices such as printers, microphones, speakers, and the like may be connected to the consumer electronic device.

The consumer electronic device may utilize an operating system having a graphical user interface (GUI), such as WINDOWS from Microsoft Corporation of Redmond, Wash., MAC OS from Apple, Inc. of Cupertino, Calif., various versions of mobile GUIs designed for mobile operating systems such as Android, and so forth. The consumer electronic device may execute one or more computer programs. Generally, the operating system and computer programs are tangibly embodied in a computer-readable medium, e.g. one or more of the fixed and/or removable data storage devices including the hard drive. Both the operating system and the computer programs may be loaded from the aforementioned data storage devices into the RAM for execution by the CPU. The computer programs may comprise instructions which, when read and executed by the CPU, cause the same to perform the steps to execute the steps or features of the present invention.

The present invention may have many different configurations and architectures. Any such configuration or architecture may be readily substituted without departing from the scope of the present invention. A person having ordinary skill in the art will recognize the above described sequences are the most commonly utilized in computer-readable mediums, but there are other existing sequences that may be substituted without departing from the scope of the present invention.

Elements of one embodiment of the present invention may be implemented by hardware, firmware, software or any combination thereof. When implemented as hardware, the audio codec may be employed on one audio signal processor or distributed amongst various processing components. When implemented in software, the elements of an embodiment of the present invention may be the code segments to perform various tasks. The software may include the actual code to carry out the operations described in one embodiment of the invention, or code that may emulate or simulate the operations. The program or code segments can be stored in a processor or machine accessible medium or transmitted by a computer data signal embodied in a carrier wave, or a signal modulated by a carrier, over a transmission medium. The "processor readable or accessible medium" or "machine readable or accessible medium" may include any medium configured to store, transmit, or transfer information.

Examples of the processor readable medium may include an electronic circuit, a semiconductor memory device, a read only memory (ROM), a flash memory, an erasable ROM (EROM), a floppy diskette, a compact disk (CD) ROM, an optical disk, a hard disk, a fiber optic medium, a radio frequency (RF) link, etc. The computer data signal includes any signal that may propagate over a transmission medium such as electronic network channels, optical fibers, air, electromagnetic, RF links, etc. The code segments may be downloaded via computer networks such as the Internet, Intranet, etc. The machine accessible medium may be embodied in an article of manufacture. The machine accessible medium may include data that, when accessed by a machine, may cause the machine to perform the operation described in the following. The term "data" here refers to any type of information that may be encoded for machine-readable purposes. Therefore, it may include program, code, data, file, etc.

All or part of an embodiment of the invention may be implemented by software. The software may have several modules coupled to one another. A software module may be coupled to another module to receive variables, parameters, arguments, pointers, etc. and/or to generate or pass results, updated variables, pointers, etc. A software module may also be a software driver or interface to interact with the operating system running on the platform. A software module may also be a hardware driver to configure, set up, initialize, send and receive data to and from a hardware device.

One embodiment of the invention may be described as a process which is usually depicted as a flowchart, a flow diagram, a structure diagram, or a block diagram. Although a block diagram may describe the operations as a sequential process, many of the operations may be performed in parallel or concurrently. In addition, the order of the operations may be re-arranged. A process may be terminated when its operations are completed. A process may correspond to a method, a program, a procedure, etc.

Overview

Embodiments of the present invention provide a method and an apparatus for calibrating multichannel surround sound systems and listener position estimation with minimal user interaction. The apparatus includes a microphone array integrated with an anchoring component of the surround sound system, which is placed at a predictable position. For example, the anchoring component can be a soundbar, a front speaker, or an A/V receiver centrally positioned directly above or below a video screen or TV. The microphone array is positioned inside or on top of the enclosure of the anchoring component such that it is facing other satellite loudspeakers of the surround sound system. The distance and angle of each satellite loudspeaker relative to the microphone array can be estimated by analyzing the inter-microphone gains and delays obtained from test signals. The estimated satellite loudspeaker positions can then be used for spatial calibration of the surround sound system to improve listening experience even if the loudspeakers are not arranged in a standard surround sound layout.

Furthermore, the microphone array may help locate a listener by 'listening' to his or her voice or other sound cues and analyzing the inter-microphone gains and delays. The listener position can be used to adapt the sweet spot for the surround sound system or other spatial audio enhancements (e.g. stereo widening). Another application of the integrated microphone array is to measure background noise for adaptive noise compensation. Based on the analysis of the environmental noise, system volume can be automatically turned up or down to compensate for background noises. In another example, the microphone array may be used to measure the "liveness" or diffuseness of the playback environment. The diffuseness measurement can help choosing proper post-processing for sound signals in order to maximize a sense of envelopment during playback. In addition to audio applications, the integrated microphone array can also be used as voice input devices for various other applications, such as VOIP and voice controlled user interfaces.

FIG. 1 is a high-level block diagram illustrating an example room environment 100 for calibrating multichannel surround sound systems including listener position estimation, according to one embodiment. A multichannel surround sound system is often arranged in speaker layouts, such as stereo, 2.1, 3.1, 5.1, 5.2, 7.1, 7.2, 11.1, 11.2 or 22.2. Other speaker layouts or arrays may also be used, such as wave field synthesis (WFS) arrays or other object-based rendering layouts. A soundbar is a special loudspeaker enclosure that can be mounted above or below a display device, such as a monitor or TV. Recent soundbar models are often powered systems comprising speaker arrays integrating left and right channel speakers with optional center speaker and/or subwoofer as well. Soundbars have become a flexible solution for either a standalone surround sound system or a key front component in home theater systems when connected with wired or wireless surround speakers and/or subwoofers. In FIG. 1, the room environment 100 comprises a 3.1 loudspeaker arrangement including a TV 102 (or a video screen), a subwoofer 104, a left surround loudspeaker 106, a right surround loudspeaker 108, a soundbar 110, and a listener 120. The soundbar 110 has integrated in its enclosure a speaker array 112, a microphone array 114, a calibration engine 116 and an A/V processing module (not shown). In other embodiments, the soundbar 110 may include different and/or few or more components than those shown in FIG. 1.

The advent of DVD, Blu-ray and streaming content has led to the availability of multichannel soundtracks as standard. However, most modern surround sound formats specify ideal loudspeaker placement to properly reproduce such content. Typical consumers that own surround sound systems often cannot comply with such specifications to set up loudspeakers due to practical reasons, such as room layout or furniture placement. This often results in a mismatch between the content producer's intent and the consumer's spatial audio experience. For example, it is the best practice to place loudspeakers along a recommended arrangement circle 130 and for the listener to sit at a sweet spot 121 in the center of the circle as shown in FIG. 1. More details on recommended loudspeaker arrangements can be found in International Telecommunication Union (ITU) Report ITU-R BS.2159-4 (05/2012) "Multichannel Sound Technology in Home and Broadcasting Applications," which is incorporated by reference in its entirety. However, due to room constraints or user preferences, the right surround loudspeaker 108 is not placed at its recommended position 109, and the listener 120 is sitting on the couch away from the sweet spot 121.

One solution for such a problem, generally known as spatial calibration, typically requires a user to place a microphone array at the default listening position (or sweet spot). By approximating the location of each loudspeaker, the system can spatially reformat a multichannel soundtrack to the actual speaker layout. However, this calibration process can be intimidating or inconvenient for a typical consumer. Another approach for spatial calibration is to install a microphone at each loudspeaker, which can be very expensive. Besides, when a listener is moving away from the sweet spot, existing methods have no way to detect this change and the listener has to go through the entire calibration process manually by putting the microphone at the new listening position. In contrast, using the integrated microphone array 114 in the soundbar 110, the calibration engine 116 can perform spatial calibration for loudspeakers as well as estimate listener's position with minimal user intervention. Since the listener position is estimated automatically, listening experience can be improved dynamically even when the listener changes position often. The listener can simply give a voice command and recalibration will be performed by the system.

Note that FIG. 1 only illustrates one example of surround sound system arrangement, other embodiments may include different speaker layouts with more or less loudspeakers. For example, the soundbar 110 can be replaced by a center channel speaker, two front channel speakers (one left and one right), and an A/V receiver to form a traditional 5.1 arrangement. In this example, the microphone array 112 may be integrated in the center channel speaker or in the A/V receiver, and coupled to the calibration engine 116, which may be part of the A/V receiver. Extra microphones or microphone arrays may be installed to face the top or left and right-side front loudspeakers for better measurement and position estimation.

Computer Architecture

Figure 2:
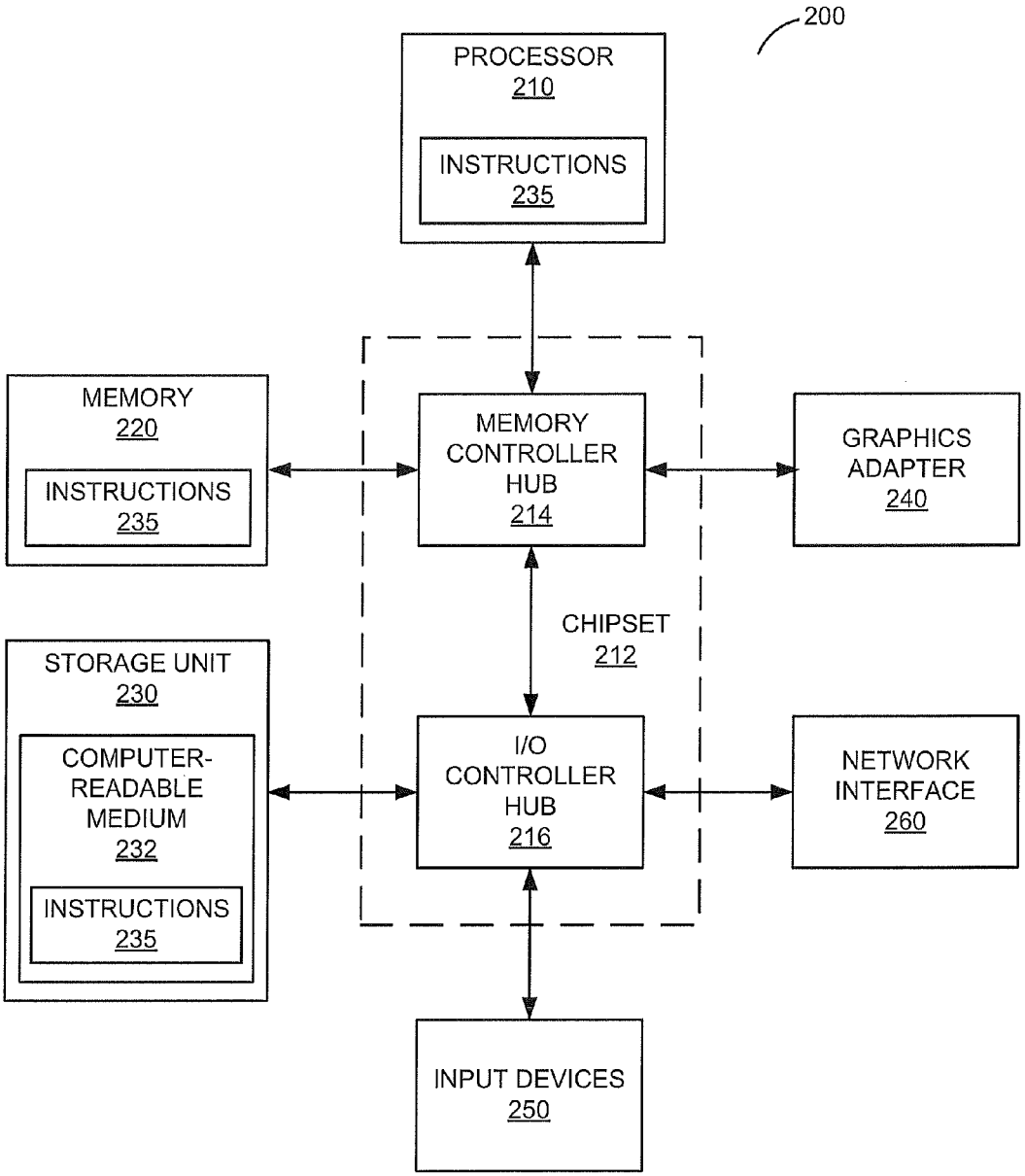
FIG. 2 is a block diagram illustrating components of an example computer, according to one embodiment.

FIG. 2 is a block diagram illustrating components of an example computer able to read instructions from a computer-readable medium and execute them in a processor (or controller) to implement the disclosed system for cloud-based digital audio virtualization service. Specifically, FIG. 2 shows a diagrammatic representation of a machine in the example form of a computer 200 within which instructions 235 (e.g., software) for causing the computer to perform any one or more of the methods discussed herein may be executed. In various embodiments, the computer operates as a standalone device or connected (e.g., networked) to other computers. In a networked deployment, the computer may operate in the capacity of a server machine or a client machine in a server-client network environment, or as a peer machine in a peer-to-peer (or distributed) network environment.

Computer 200 is such an example for use as the calibration engine 116 in the example room environment 100 for calibrating multichannel surround sound systems including listener position estimation shown in FIG. 1. Illustrated are at least one processor 210 coupled to a chipset 212. The chipset 212 includes a memory controller hub 214 and an input/output (I/O) controller hub 216. A memory 220 and a graphics adapter 240 are coupled to memory controller hub 214. A storage unit 230, a network adapter 260, and input devices 250, are coupled to the I/O controller hub 216. Computer 200 is adapted to execute computer program instructions 235 for providing functionality described herein. In the example shown in FIG. 2, executable computer program instructions 235 are stored on the storage unit 230, loaded into the memory 220, and executed by the processor 210. Other embodiments of computer 200 may have different architectures. For example, memory 220 may be directly coupled to processor 210 in some embodiments.

Processor 210 includes one or more central processing units (CPUs), graphics processing units (GPUs), digital signal processors (DSPs), application specific integrated circuits (ASICs), radio-frequency integrated circuits (RFICs), or any combination of these. Storage unit 230 comprises a non-transitory computer-readable storage medium 232, including a solid-state memory device, a hard drive, an optical disk, or a magnetic tape. The instructions 235 may also reside, completely or at least partially, within memory 220 or within processor 210's cache memory during execution thereof by computer 200, memory 220 and processor 210 also constituting computer-readable storage media. Instructions 235 may be transmitted or received over network 140 via network interface 260.

Input devices 250 include a keyboard, mouse, track ball, or other type of alphanumeric and pointing devices that can be used to input data into computer 200. The graphics adapter 212 displays images and other information on one or more display devices, such as monitors and projectors (not shown). The network adapter 260 couples the computer 200 to a network, for example, network 140. Some embodiments of the computer 200 have different and/or other components than those shown in FIG. 2. The types of computer 200 can vary depending upon the embodiment and the desired processing power. Furthermore, while only a single computer is illustrated, the term "computer" shall also be taken to include any collection of computers that individually or jointly execute instructions 235 to perform any one or more of the methods discussed herein.

Calibration Engine

The inclusion of the microphone array 114 placed around the midpoint of the sound bar 110 is all that necessary for the calibration engine 116 to estimate each surround loudspeaker's position relative to the soundbar. Since the soundbar is usually predictably placed directly above or below the video screen (or TV), the geometry of the measured distance and incident angle can be translated to an absolute position relative to any point in front of that reference soundbar location using simple trigonometric principals.

Generally, a multi-element microphone array with two or more microphones integrated in an anchoring speaker or receiver (e.g., soundbar 110) is capable of measuring incident wave fronts from many directions, especially in the front plane. A two-element (stereo) microphone array is capable of determining two-dimensional positions of left and right satellite loudspeaker within a 180 degree 'field of view' without ambiguity. The position of a loudspeaker thus determined includes a distance and an angle between the loudspeaker and the integrated microphone array. For localization of a listener in front of it, a microphone array with at least three elements can be used to determine the distance and angle between the listener and the microphone array. In order to determine spatial information in three dimension, one more microphone has to be added to the microphone array for estimating both the loudspeaker and listener positions due to the extra height axis.

In one embodiment, the integrated microphone array may be mounted inside the enclosure of the anchoring component, such as a soundbar, a front speaker or an A/V receiver. Alternatively or in addition, the microphone array may be mounted in other fixed relationships to the anchoring component, such as at the top or bottom, on the left or right side, to the front or back of the enclosure.

Figure 3A:
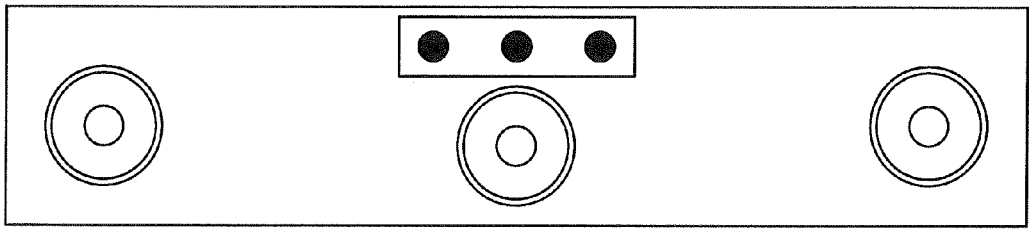
FIGS. 3A-3D are block diagrams illustrating various example configurations of soundbars with integrated microphone array, according to various embodiments.
Figure 3B:
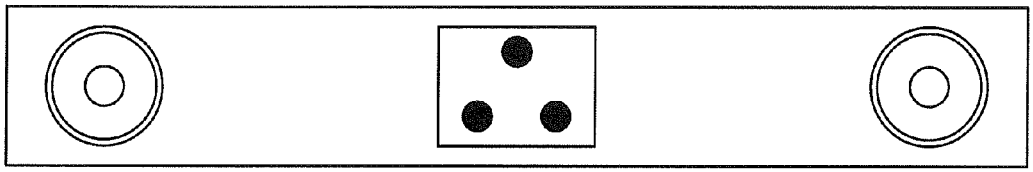
Figure 3C:
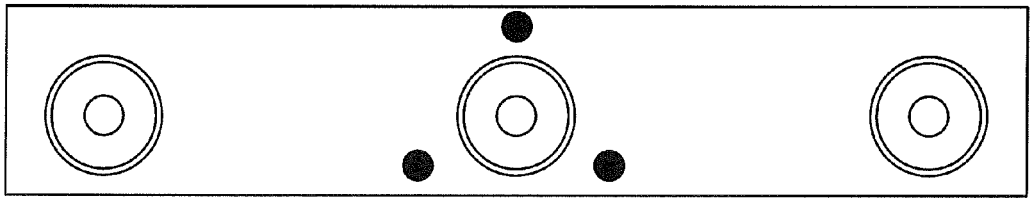
Figure 3D:
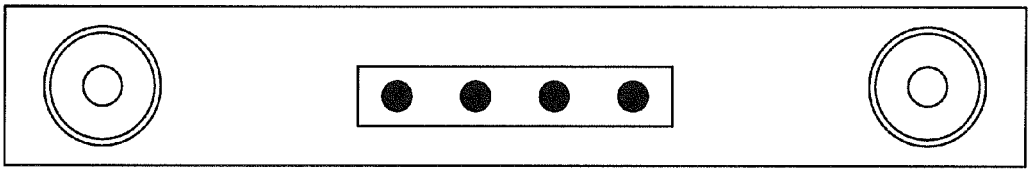

FIGS. 3A-3D are block diagrams illustrating various example configurations of the soundbar 110 with integrated microphone array, according to various embodiments. FIG. 3A shows a soundbar with a linear microphone array of three microphones mounted above the center speaker of the soundbar. This linear array of three microphones is suitable for estimating loudspeaker or listener position in a 2-D plane. FIG. 3B illustrates an example design where the microphone array is mounted on the front center of the soundbar. The microphone array includes a third microphone place on top of a pair of stereo microphones, which allows position estimation in both horizontal and vertical directions. FIG. 3C demonstrates a similar design in which the three microphones are placed around the front center speaker in the soundbar. FIG. 3D shows yet another linear microphone array configuration with four microphones mounted on the front center of the soundbar to improve the estimation accuracy of the loudspeakers and listener positions.

In other embodiments, the microphone array integrated in an anchoring component (e.g., soundbar, front channel speakers, or the A/V receiver) of the surround sound system may include different numbers of microphones, and have different configurations other than linear or triangle arrays shown in FIGS. 3A-3D. The microphone array may also be placed in different positions inside the enclosure of the anchoring component. Furthermore, the microphone array may be positioned inside the enclosure of the anchoring component to face top and/or bottom, left and/or right, front and/or back, or any combinations of these directions thereof.

Figure 4:
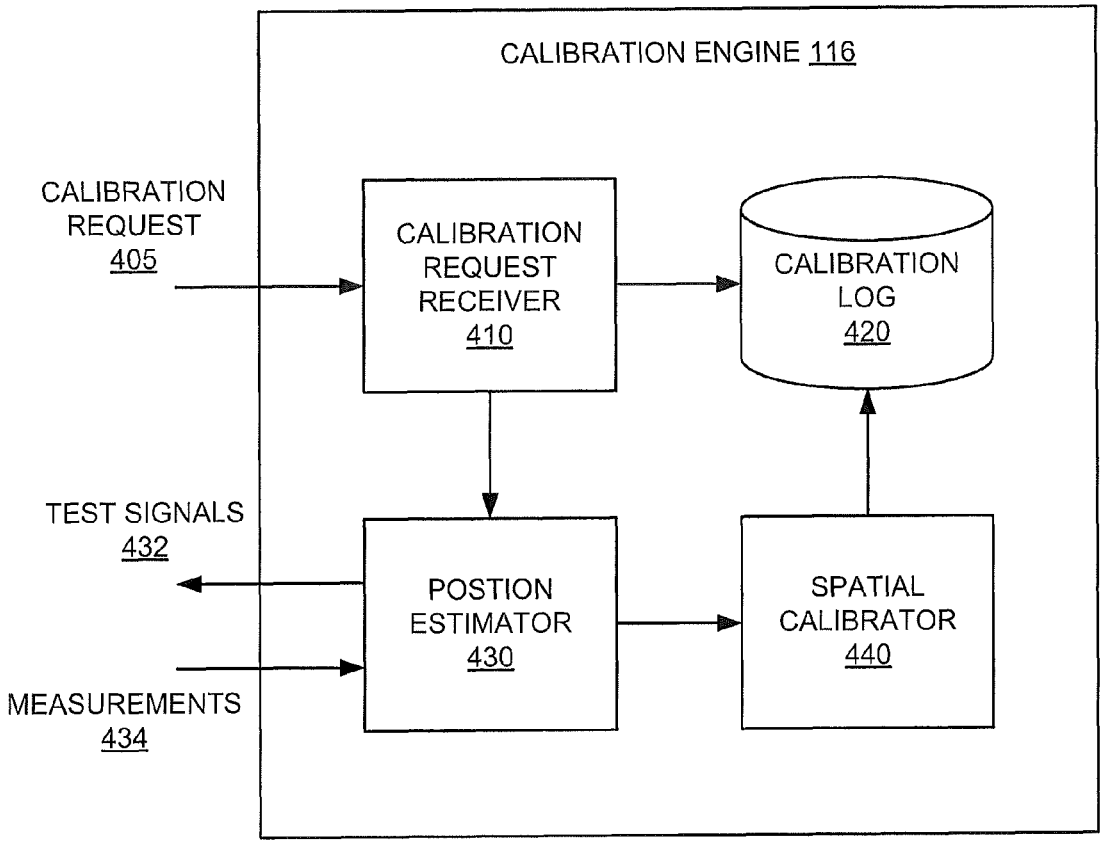
FIG. 4 is a block diagram illustrating functional modules within a calibration engine for calibrating surround sound systems, according to one embodiment.

The calibration engine 116 controls the process of loudspeaker and listener position estimations and spatial calibration of the multichannel surround sound systems. FIG. 4 is a block diagram illustrating functional modules within the calibration engine 116 for the surround sound system calibration including listener position estimation. In one embodiment, the calibration engine 116 comprises a calibration request receiver module 410, a calibration log database 420, a position estimator module 430, and a spatial calibrator module 440. As used herein, the term "module" refers to a hardware and/or software unit used to provide one or more specified functionalities. Thus, a module can be implemented in hardware, software or firmware, or a combination of thereof. Other embodiments of the calibration engine 116 may include different and/or fewer or more modules.

The calibration request receiver 410 receives requests from users or listeners of the surround sound systems to perform positions estimation and spatial calibration. The calibration requests may come from button pressing events on a remote, menu item selections on a video or TV screen, or voice commands picked up by the microphone array 114, among other means. After receiving a calibration request 405, the calibration request receiver 410 may determine whether to estimate positions of the loudspeakers, position of the listener, or both before passing the request to the position estimator 430. The calibration request receiver 410 may also update the calibration log 420 with information, such as date and time of the received request 405 and tasks requested.

Figure 5A:
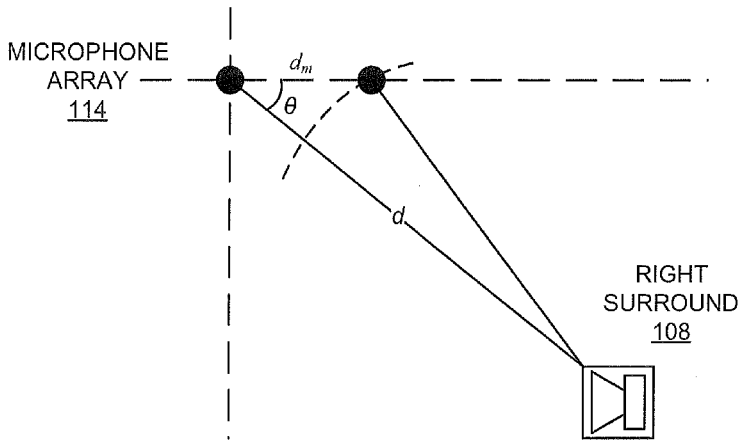
FIG. 5A-5C are diagrams illustrating a test setting and test results for estimating the distance and an angle between a loudspeaker and a microphone array, according to one embodiment.

The position estimator 430 estimates the distance and angle of a loudspeaker relative to the microphone array based on test signals 432 played by the loudspeaker and measurements 434 received at the microphone array. FIG. 5A is a diagram illustrating an example test setting for estimating the distance d and angle θ between the right surround speaker 108 and microphone array 114.

Figure 5B:
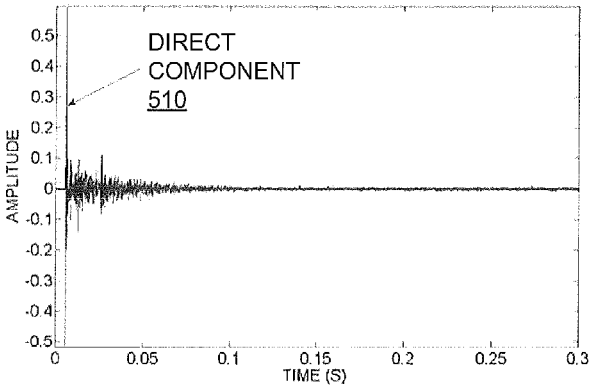

In one embodiment, the distance between a loudspeaker and a microphone is estimated by playing a test signal and measuring the time of flight (TOF) between the emitting loudspeaker and the receiving microphone. The time delay of the direct component of a measured impulse response can be used for this purpose. The direct component represents the sound signals that travel directly from the emitting loudspeaker to the receiving microphone without any reflections. The impulse response between the loudspeaker and a microphone array element can be obtained by playing a test signal through the loudspeaker under analysis. Test signal choices include a maximum length sequence (MLS), a chirp signal, also known as the logarithmic sine sweep (LSS) signal, or other test tones. The room impulse response can be obtained, for example, by calculating a circular cross-correlation between the captured signal and the MLS input. FIG. 5B shows an impulse response thus obtained using an MLS input of order 16 with a sequence of 65535 samples. This impulse response is similar to a measurement taken in a typical office or living room. The delay of the direct component 510 can be used to estimate the distance d between the surround loudspeaker 108 and the microphone array element. Note that for loudspeaker distance estimation, any loopback latency of the audio device used to play the test signal (e.g., the surround loudspeaker 108) needs to be removed from the measured TOF.

The MLS test signals captured by a stereo microphone array including two microphone elements can be used to estimate the angle θ of the loudspeaker 108. In one embodiment, the angle is calculated based on one of the most commonly used methods for sound source localization called time-delay of arrival (TDOA) estimation and a common solution to the TDOA, the generalized cross correlation (GCC) solution is represented as:

$$\tau = \underset{\beta}{\operatorname{argmax}} \int_{-\infty}^{\infty} W(\omega) X_1(\omega) \overline{X_2(\omega)} e^{-j\omega\beta} d\omega,$$

where τ is an estimate of the TDOA between the two microphone elements, $X_1(\omega)$ and $X_2(\omega)$ are the Fourier transforms of the signals captured by the two microphone elements, and $W(\omega)$ is a weighting function.

In GCC-based TDOA estimation, various weighting functions can be adopted, including the maximum likelihood (ML) weighting function and phase transform based weighting function (GCC-PHAT). The GCC-PHAT weighting function is defined as $$W(\omega) = \frac{1}{|X_1(\omega)\overline{X_2(\omega)}|}.$$

The GCC-PHAT method utilizes the phase information exclusively and is found to be more robust in reverberant environments. An alternative weighting function for GCC is the smoothed coherence transform (GCC-SCOT), which can be expressed as $$W(\omega) = \frac{1}{\sqrt{P_{X_1X_1}(\omega)P_{X_2X_2}(\omega)}},$$

where $P_{X_1X_1}(\omega)$ and $P_{X_2X_2}(\omega)$ are the power spectrum of $X_1(\omega)$ and $X_2(\omega)$ respectively. The power spectrum can be estimated using a running average of the magnitude spectrum.

Assume that the distance between two microphones is $d_m$ (in meter), the angle θ of the loudspeaker (in radians) can be estimated as $$\theta = \cos^{-1}\frac{\tau C}{d_m},$$

where C is the speed of sound in air, which is approximately 342 m/s, and τ is the estimated time delay. Based on the estimated distance d and angle θ, the position estimator 430 can compute the coordinates of the loudspeaker using trignometry.

Figure 5C:
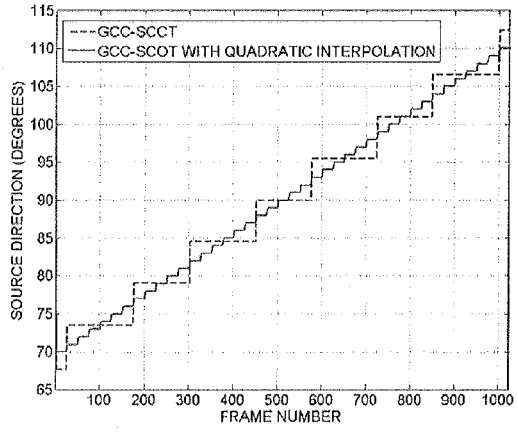

In testing the performance of the loudspeaker position estimation, simulations have been conducted, in which a test input with source direction changing from 70 to 110 degrees with one degree increment is generated. Sampling rate of the signals was set to 48 kHz. The distance between the two microphone elements was set to 7.5 cm. To avoid spatial aliasing, the maximum frequency processed was limited to be less than 2.3 KHz. FIG. 5C shows the test results of the source direction estimations using both GCC-SCOT with and without quadratic interpolation. Without the quadratic interpolation, the GCC-SCOT algorithm lacks the accuracy to identify all the changes in the source direction due to limited spatial resolution (dotted line). Whereas with the quadratic interpolation, the detection is successful with significantly improved accuracy; all the changes in the source direction are identified correctly (solid line).

In various embodiments, to increase the robustness of the estimation methods, a histogram of all the possible TDOA estimates can be used to select the most likely TDOA in a specified time interval. The average of the interpolated output for the chosen TDOA candidate can then be used to further increase the accuracy of the TDOA estimate. Experiments conducted in a typical office environment with a GCC-SCOT weighting function prove that the algorithm can reliably estimate a loudspeaker's distance and angle. The average error in loudspeaker distance estimation is less than three centimeters.

Most spatial calibration systems require the use of a multi-element microphone placed at an assumed listening position. In practice, a listener often listens to the surround sound system away from the measured listening position. As a result, the listening experience degrades significantly for the listener as the surround system may have reformatted the original content assuming the originally measured position. To correct this, typical calibration systems require the listener to go through another calibration measurement at the new listening position. This is not necessary for the calibration engine 116 since the position estimator 430 can detect a listener's actual listening position using the integrated microphone array 114 without going through the recalibration.

In one embodiment, to ensure that the listener's position is detected only when intended, a key phrase detection can be configured to trigger the listener position estimation process. For example, a listener can say a key phase such as "DTS Speaker" to activate the process. Other sound cues made by the listener can also be used as input signal to the position estimator 430 for listener position estimation.

Existing methods for microphone array based sound source localization include TDOA based estimation and steered response power (SRP) based estimation. While these methods can be used to localize sound source in three dimensions, it is assumed that the microphone array and the sound source (i.e., the listener) having the same height in the following descriptions for clarity purpose. That is, only two-dimensional sound source localization is described, three-dimensional listener position can be estimated using similar techniques.

Figures 6A, 6B:
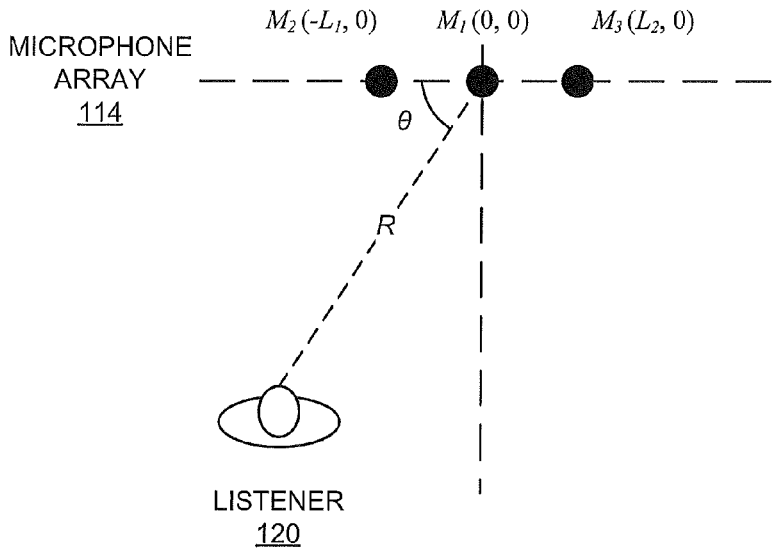
FIG. 6A-6B are diagrams illustrating a test setting and test results for estimating the distance and an angle between a listener and a microphone array, according to one embodiment.

In one embodiment, the position estimator 430 adopts the TDOA-based sound source localization for estimating the listener position. FIG. 6A illustrates an example three-element linear microphone array used to capture a listener's voice input. The three microphone elements are marked with their respective coordinates of $M_1(0, 0)$, $M_2(-L_1, 0)$, and $M_3(L_2, 0)$. Upon receiving the voice input or other sound cues from the listener 120, a closed-form solution for the distance R and angle θ of the listener 120 relative to the microphone array can be computed as:

$$R = \frac{L_1\left(1-\left(\frac{d_{21}}{L_1}\right)^2\right)+L_2\left(1-\left(\frac{d_{31}}{L_2}\right)^2\right)}{2\left(\frac{d_{31}}{L_2}-\frac{d_{21}}{L_1}\right)} \text{ and}$$

$$\theta = \cos^{-1}\left(\frac{L_2^2-2Rd_{31}-d_{31}^2}{2RL_2}\right),$$

where $d_{ij}$ is the distance difference between microphone $M_i$ and $M_j$ relative to the sound source (i.e., the listener 120), and $d_{ij}=C\tau_{ij}$, where $\tau_{ij}$ is the TDOA between microphone $M_i$ and $M_j$ and C is the speed of sound in air.

Alternatively, a steered response power (SRP) based estimation algorithm can be implemented by the position estimator 430 to localize the listener's position. In SRP, the output power of a filter-and-sum beamformer, such as a simple delay and sum beamformer, is calculated for all possible sound source locations. The position that yields the maximum power is selected as the sound source position. For example, an SRP phase transform (SRP-PHAT) can be computed as the sum of the GCC for all possible pairs of the microphones expressed in $$P = \sum_{l=1}^{N}\sum_{k=1}^{N}\int_{-\infty}^{\infty} W_{lk}(\omega)X_l(\omega)\overline{X_k(\omega)}e^{-j\omega(\tau_l-\tau_k)}d\omega,$$

where $\tau_l$ and $\tau_k$ are the delays from the source location to microphones $M_l$ and $M_k$, respectively, and $W_{lk}$ is a filter weight defined as $$W_{lk}(\omega) = \frac{1}{|X_l(\omega)\overline{X_k(\omega)}|}.$$

The SRP-PHAT method can also be applied to three-dimensional sound source localization as well as two-dimensional sound source localization.

Tests have been conducted in a typical office environment similar to the room environment 100 to evaluate the performances of the TDOA-based method and SRP-PHAT method. FIG. 6B shows a table of the test results of distance estimations. A four-element microphone array is used for testing. The TDOA-based method utilizes three out of the four microphones, while the SRP-PHAT method uses all four microphones. As shown in the result table of FIG. 6B, the SRP-PHAT method using four microphones estimated the listener position with better accuracy; average error of the estimated distance is less than 10 cm.

Referring back to FIG. 4. Now that the angular position and distance of any surround loudspeaker and an individual listener are identified by the position estimator 430. This information can be passed to the spatial calibrator 440 to reform the multichannel sound signals directed towards the listener's physical loudspeaker layout to better preserve the artistic intent of the content producer. Based on the estimated positions of each loudspeaker and the listener relative to the microphone array, the spatial calibrator 440 can derive the distances and angles between each loudspeaker and the listener using trigonometry. The spatial calibrator 440 can then perform various spatial calibrations to the surround sound system, once the distances from each loudspeaker to the listener have been established.

In one embodiment, the spatial calibrator 440 adjusts the delay and gain of multichannel audio signals sent to each loudspeaker based on the derived distances from each loudspeaker to the listener. Assume that the distance from the $i^{th}$ loudspeaker to the listener is $d_i$, and the maximum distance among $d_i$ is $d_{max}$. The spatial calibrator 440 applies a compensating delay (in samples) to all loudspeakers closer to the listener using the following equation:

$$\Delta\tau_i = (d_{max} - d_i) * \frac{R_s}{C},$$

where $R_s$ is the sampling rate of the audio signals and C is the speed of sound in air. In addition, since sound pressure at the listening position is in general inversely proportional to the squared distance between the loudspeaker and the listener. Therefore, the sound level (in dB) can be adjusted for the $i^{th}$ loudspeaker based on the distance differences by:

$$\Delta I_i = 10 * \log\left(\frac{d_i^2}{d_{max}^2}\right).$$

In addition to the above described adjustments to delay and gain, the spatial calibrator 440 can also reformat the spatial information on the actual layout. For instance, the right surround speaker 108 shown in FIG. 1 is not placed at its recommended position 109 with the desired angle on the recommended arrangement circle 130. Since the actual angles of the loudspeakers, such as the surround loudspeaker 108, are now known and the per-speaker gains and delays have been appropriately compensated, the calibration engine 116 can now reformat the spatial information on the actual layout through passive or active up/down mixing. One way to achieve this is for the spatial calibrator 440 to regard each input channel as a phantom source between two physical loudspeakers and pair-wise-pan these sources to the originally intended loudspeaker positions with the desired angle.

There exists a variety of techniques for panning a sound source, such as vector base amplitude palming (VBAP), distance-based amplitude panning (DBAP), and Ambisonics. In VBAP, all the loudspeakers are assumed to be positioned approximately the same distance away from the listener. A sound source is rendered using either two loudspeakers for two-dimensional panning, or three loudspeakers for three-dimensional panning. On the other hand, DBAP has no restrictions on the number of loudspeakers and renders the sound source based on the distances between the loudspeakers and the sound source. The gain for each loudspeaker is calculated independent of the listener's position. If the listening position is known, the performance of DBAP can be improved by adjusting the delays so that the sound from each loudspeaker arrives at the listener at the same time.

In one embodiment, the spatial calibrator 440 applies spatial correction to loudspeakers that are not placed at the right angles for channel-based audio content by using the sound panning techniques to create virtual speakers (or phantom sources) at recommended positions with the correct angles based off the actual speaker layout. For example, in the room environment shown in FIG. 1, spatial correction for the right surround speaker 108 can be achieved by panning the right surround channel at the recommended position 109. As another example, due to its size limitation, the front left and front right speakers inside the soundbar 110 are positioned much closer (e.g., 10 degrees) to the center plane than recommended (e.g., 30 degrees). As a result, the frontal image may sound very narrow even if the listener sits at the sweet spot 121. To mitigate the situation, the spatial calibrator 440 can create a virtual front left speaker and a virtual front right speaker at 30 degrees position on the recommended arrangement circle 130 with sound source panning. Test result has shown that the frontal sound image is enlarged through VBAP-based spatial correction. Furthermore, spatial correction can also be used for rendering channel positions not present on the output layout, for example, rendering 7.1 on the currently assumed layout in the room environment 100.

In one embodiment, the spatial calibrator 440 provides spatial correction for rendering object-based audio content based on the actual positions of the loudspeakers and the listener. Audio objects are created by associating sound sources with position information, such as location, velocity and the like. Position and trajectory information of audio objects can be defined using two or three dimensional coordinates. Using the actual positions of the loudspeaker and listener, the spatial calibrator 440 can determine which loudspeaker or loudspeakers are used for playing back objects' audio.

When the listener 120 moves away from the sweet spot 121, the calibration problem can be treated as if most loudspeakers in the surround sound system have moved away from the recommended positions. Obviously, the listening experience will be significantly degraded without applying any spatial calibration. For instance, when the soundbar 110 is active, the listener 120 at his or her current position may think the signal only comes from the left element of the speaker array 112 due to distance differences. The delays and gains from all the loudspeakers need to be adjusted. In one embodiment, when the listener 120 changes his or her position, the spatial calibrator 440 uses the new listener position as the new sweet spot, and applies the spatial correction based on each loudspeaker's angular position. In addition to the spatial correction, the spatial calibrator 440 also readjusts the delays and gains for all the loudspeakers.

Tests have been conducted in a listening room similar to the room environment 100 shown in FIG. 1 to evaluate the effectiveness of the spatial correction when the listener moves away from the sweet spot. The spatial calibrator 440 implements the VBAP-based passive remix for spatial correction. In the tests, a single sound source is panned around the listener based on a standard 5.1 speaker layout. The input signals for each loudspeaker are first processed by the spatial correction algorithms, and then passed through the delay and gain adjustments within the spatial calibration engine. One playback with the spatial calibration and one without are presented to five individual listeners, who have been asked to pick the playback with better effect of which the sound source moves continuously around the listener in a circle. All listeners have identified the playback with the spatial correction and distance adjustments applied.

After the spatial calibrator 440 performs the delay and gain adjustments and spatial correction, the positions and calibration information can be cached and/or recorded in the calibration log 420 for further reference. For example, if a new calibration request 405 is received and the position estimator 430 determines that the positions of the loudspeakers have not changed or the changes are below a predetermined threshold, the spatial calibrator 440 may simply update the calibration log 420 and skip the recalibration process in response to the insignificant position changes. If it is determined that any newly estimated positions match a previous calibration record, the spatial calibrator 440 can conveniently retrieves the previous record from the calibration log 420 and applies the same spatial calibration. In case a recalibration is indeed required, the spatial calibrator 440 may consult the calibration log 420 to determine whether to perform partial or incremental adjustment or full recalibration depending on the calibration history and/or significance of the changes.

Figure 7:
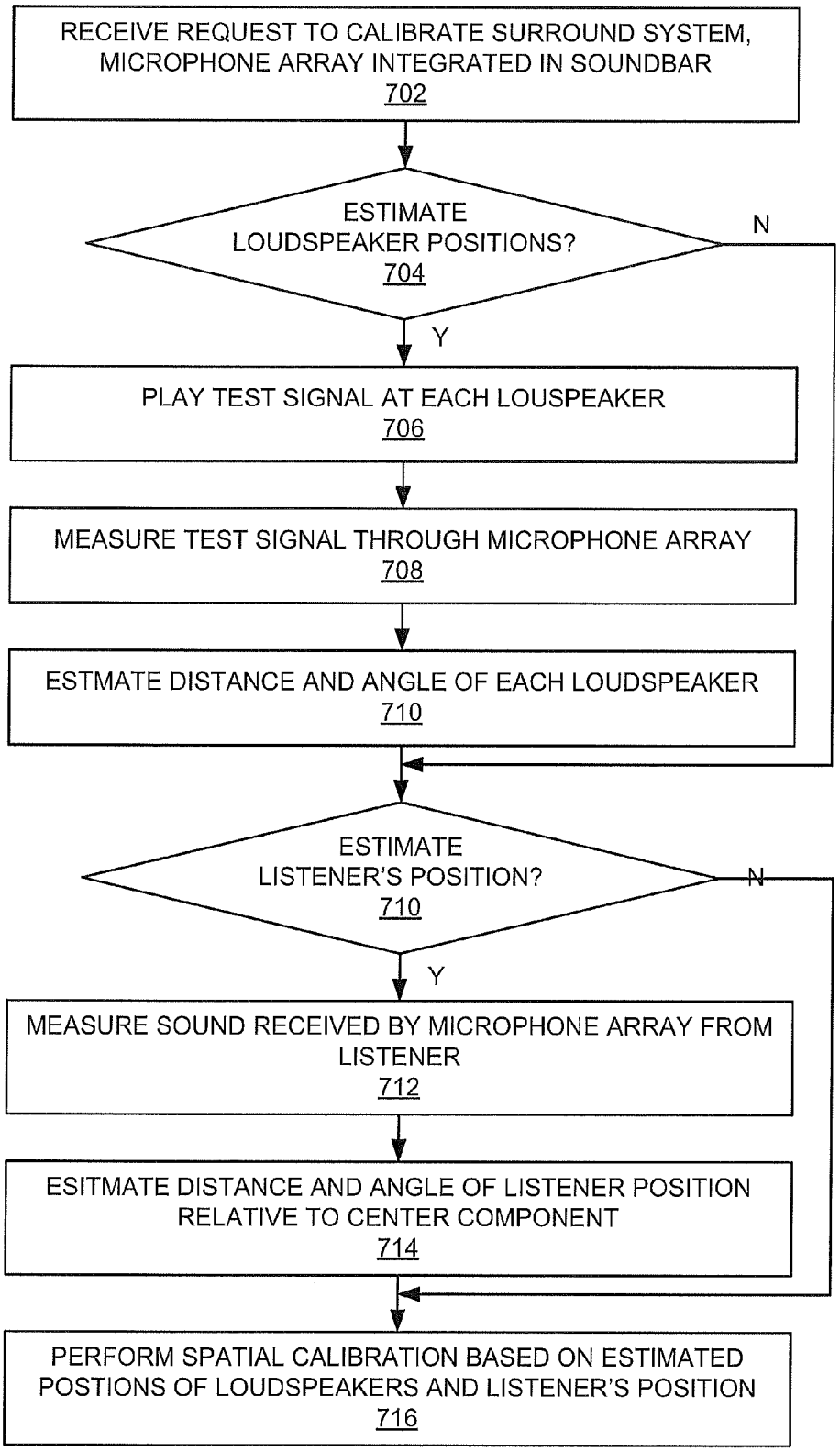
FIG. 7 is a flowchart illustrating an example process for providing surround sound system calibration including listener position estimation, according to one embodiment.

FIG. 7 is a flowchart illustrating an example process for providing surround sound system calibration including listener position estimation, according to one embodiment. It should be noted that FIG. 7 only demonstrates one of many ways in which the position estimations and calibration may be implemented. The method is performed by a calibration system including a processor and a microphone array (e.g., microphone array 114) integrated in an anchoring component, such as a soundbar (e.g., soundbar 110), a front speaker, or an A/V receiver. The method begins when the calibration system receives 702 a request to calibrate the surround sound system. The calibration request may be sent from a remote control, selected from a setup menu, or triggered by a voice command from the listener of the surround sound system. The calibration request may be invoked for initial system setup or for recalibration of the surround sound system due to changes in system configuration, loudspeaker layout, and/or listener's position.

Next, the calibration system determines 704 whether to estimate the positions of the loudspeakers in the surround sound system. In one embodiment, the calibration system may have a default configuration for this estimation requirement. For example, estimation is required for initial system setup and not required for recalibration. Alternatively or in addition, the received calibration request may explicitly specify whether or not to perform position estimations to override the default configuration. The calibration request may optionally allow the listener to identify which loudspeaker or loudspeakers have been repositioned, thus require position estimation. If so determined, the calibration system continues to perform position estimation for at least one loudspeaker.

For each of the one or more loudspeakers of which positions to be estimated, the calibration system plays 706 a test signal, and measures 708 the test signal through the integrated microphone array. Based on the measurement, the calibration system estimates 710 the distance and angle of the loudspeaker relative to the microphone array. As described above, the test signal can be a chirp or a MLS signal, and the distance and angle can be estimated using a variety of existing algorithms, such as TDOA and GCC.

After each of the requested loudspeaker positions has been computed, or none estimation is required, the calibration system determines 710 whether to estimate the listener's position. Similarly, the listener position estimation may be required for initial setup and/or triggered by changes in the listening position. If the calibration system determines that listener position estimation is to be performed, it measures 712 the sound received by the microphone array from the listener. The sound for position estimation can be the same voice command that invokes the listener position estimation or any other sound cues from the listener. The calibration system then estimates 714 the distance and angle of the listener position relative to the microphone array. Example estimation methods include TDOA and SRP.

After the listener's position has been computed, or no estimation of the listener position is required, the calibration system performs 716 spatial calibration based on updated or previously estimated position information of the loudspeakers and the listener. The spatial calibrations include, but not limited to, adjusting the delay and gain of the signal for each loudspeaker, spatial correction, and accurate sound panning.

In conclusion, embodiments of the present invention provide a system and a method for spatial calibrating surround sound systems. The calibration system utilizes a microphone array integrated into a component of the surround sound system, such as a center speaker or a soundbar. The integrated microphone array eliminates the need for a listener to manually position the microphone at the assumed listening position. In addition, the calibration system is able to detect the listener's position through his or her voice input. Test results show that the calibration system is capable of detecting accurately the positions of the loudspeakers and the listener. Based on the estimated loudspeaker positions, the system can render a sound source position more accurately. For channel based input, the calibration system can also perform spatial correction to correct spatial errors due to imperfect loudspeaker setup.

The particulars shown herein are by way of example and for purposes of illustrative discussion of the embodiments of the present invention only, and are presented in the case of providing what is believed to be the most useful and readily understood description of the principles and conceptual aspects of the present invention. In this regard, no attempt is made to show particulars of the present invention in more detail than necessary for the fundamental understanding of the present invention, the description taken with the drawings make apparent to those skilled in the art how the several forms of the present invention may be embodied in practice.

What is claimed is:

1. A method for calibrating a multichannel surround sound system including a soundbar and one or more surround loudspeakers, the method comprising:

receiving, by microphone array integrated into the soundbar, a test signal played at a surround loudspeaker to be calibrated, the integrated microphone array comprising a plurality of microphones mounted in a relationship to the soundbar;

estimating a position of the surround loudspeaker relative to the integrated microphone array based on the received test signal at the plurality of microphones;

receiving, by the microphone array, a sound from a listener;

estimating a position of the listener relative to the integrated microphone array based on the received sound at the plurality of microphones;

deriving a distance and an angle between the surround loudspeaker and the listener based on the estimated position of the surround loudspeaker relative to the integrated microphone array and the estimated position of the listener relative to the integrated microphone array; and performing a spatial calibration to the surround sound system based at least on the derived distance and angle between the surround loudspeaker and the listener.

2. The method of claim 1, wherein the integrated microphone array is mounted on the front center of the soundbar.

3. The method of claim 1, wherein the position of the surround loudspeaker and the position of the listener each includes a distance and an angle relative to the microphone array.

4. The method of claim 3, wherein the position of the loudspeaker is estimated based on a direct component of the received test signal.

5. The method of claim 3, wherein the angle of the loudspeaker is estimated using two or more microphones in the microphone array and based on a time difference of arrival (TDOA) of the test signal at the two or more microphones in the microphone array.

6. The method of claim 1, wherein the sound from the listener includes the listener's voice or other sound cues made by the listener.

7. The method of claim 1, wherein the position of the listener is estimated using three or more microphones in the microphone array.

8. The method of claim 1, wherein performing the spatial calibration comprises:

adjusting delay and gain of a sound channel for the surround loudspeaker based on the estimated position of the surround loudspeaker and the listener; and correcting spatial position of the sound channel by panning the sound channel to a desired position based on the estimated positions of the surround loudspeaker and the listener.

9. The method of claim 1, wherein performing the spatial calibration comprises panning a sound object to a desired position based on the estimated positions of the surround loudspeaker and the listener.

10. A method comprising:

receiving a request to calibrate a multichannel surround sound system including a soundbar with an integrated microphone array and one or more surround loudspeakers;

responsive to the request including estimating a position of a surround loudspeaker, playing a test signal at the surround loudspeaker; and estimating the position of the surround loudspeaker relative to the integrated microphone array based on received test signal from the surround loudspeaker at the integrated microphone array;

responsive to the request including estimating a position of a listener, estimating the position of the listener relative to the integrated microphone array based on a received sound from the listener at the integrated microphone array;

deriving a distance and an angle between the surround loudspeaker and the listener based on the estimated position of the surround loudspeaker relative to the integrated microphone array and the estimated position of the listener relative to the integrated microphone array; and performing a spatial calibration to the surround sound system based at least on the derived distance and angle between the surround loudspeaker and the listener.

11. An apparatus for calibrating a multichannel surround sound system including one or more loudspeakers, the apparatus comprising:

a microphone array with two or more microphones integrated in a front component of the surround sound system, wherein the integrated microphone array is configured for receiving a test signal played at a loudspeaker to be calibrated, and for receiving a sound from the listener;

an estimation module configured for:

estimating a position of the loudspeaker relative to the integrated microphone array based on the received test signal from the loudspeaker, and for estimating a position of the listener relative to the integrated microphone array based on the received sound from the listener; and deriving a distance and an angle between the surround loudspeaker and the listener based on the estimated position of the surround loudspeaker relative to the integrated microphone array and the estimated position of the listener relative to the integrated microphone array; and a calibration module configured for performing a spatial calibration to the surround sound system based at least on the derived distance and angle between the surround loudspeaker and the listener.

12. The apparatus of claim 11, wherein the front component of the surround sound system is one of a soundbar, a front loudspeaker and an A/V receiver.

13. The apparatus of claim 11, wherein the position of the loudspeaker and the position of the listener each includes a distance and an angle relative to the microphone array.

14. The apparatus of claim 13, wherein the position of the loudspeaker is estimated based on a direct component of the received test signal.

15. The apparatus of claim 13, wherein the angle of the loudspeaker is estimated using two or more microphones in the microphone array and based on a time difference of arrival (TDOA) of the test signal at the two or more microphones in the microphone array.

16. The apparatus of claim 11, wherein the position of the listener is estimated using three or more microphones in the microphone array.

17. The apparatus of claim 11, wherein performing the spatial calibration comprises:

adjusting delay and gain of a sound channel for the loudspeaker based on the estimated position of the loudspeaker and the listener; and correcting spatial position of the sound channel by panning the sound channel to a desired position based on the estimated positions of the surround loudspeaker and the listener.

18. The apparatus of claim 11, wherein performing the spatial calibration comprises panning a sound object to a desired position based on the estimated positions of the surround loudspeaker and the listener.

19. A system for calibrating a multichannel surround sound system including one or more loudspeakers, the system comprising:

a microphone array with two or more microphones integrated in a front component of the surround sound system, wherein the microphone array is configured for receiving a test signal played at a loudspeaker to be calibrated and for receiving a sound from the listener;

an estimation module configured for:

estimating a position of the loudspeaker relative to the integrated microphone array based on the received test signal from the loudspeaker, and for estimating a position of the listener relative to the integrated microphone array based on the received sound from the listener; and deriving a distance and an angle between the surround loudspeaker and the listener based on the estimated position of the surround loudspeaker relative to the integrated microphone array and the estimated position of the listener relative to the integrated microphone array; and a calibration module configured for performing a spatial calibration to the surround sound system based at least on the derived distance and angle between the surround loudspeaker and the listener.

20. The system of claim 19, wherein the front component of the surround sound system is one of a soundbar, a front loudspeaker and an A/V receiver.

* * * * *